United States Patent [19]

Lassmann et al.

[11] Patent Number: 4,574,410

[45] Date of Patent: Mar. 11, 1986

[54] DEVICE FOR HANDLING PEOPLE

[75] Inventors: Dieter Lassmann, Lormes/Ursigny; Rémy Vialla, Paris; Léo Jouk, Le Pre Saint-Gervais, all of France

[73] Assignee: Establissements Jouk, France

[21] Appl. No.: 622,806

[22] Filed: Jun. 20, 1984

[30] Foreign Application Priority Data

Jun. 23, 1983 [FR] France ..... 83 10369
Dec. 9, 1983 [FR] France ..... 83 19735

[51] Int. Cl.[4] ..... A61G 7/08; A61G 7/10

[52] U.S. Cl. ..... 5/81 R; 5/85; 5/89

[58] Field of Search ..... 5/81 R, 83, 85–89; 297/335, 383

[56] References Cited

U.S. PATENT DOCUMENTS 2,679,890 6/1954 Zannoth ..... 5/86
2,697,475 12/1954 Dueth ..... 5/81 R
3,608,104 9/1971 Van Gerven ..... 5/83
3,623,169 11/1971 James ..... 5/81 R
3,790,974 2/1974 Johanssonn ..... 5/81 R
3,914,808 10/1975 Woods ..... 5/86
4,255,823 3/1981 Boyer et al. ..... 5/81 R

FOREIGN PATENT DOCUMENTS 2100979 1/1983 United Kingdom ..... 5/81 R

*Primary Examiner*—Kenneth J. Dorner
*Assistant Examiner*—Michael F. Trettel
*Attorney, Agent, or Firm*—Sughrue, Mion, Zinn, Macpeak & Seas

[57] ABSTRACT

The present invention relates to devices for handling at least one person.

The device essentially comprises a base 1, a support 10 associated with the base, a seat 16 mounted on the support, the seat being able to take at least two symmetrical positions in relation to a plane passing through said support 10, the projection of the seat in its two positions being contained in said base 1.

Application for the transport of handicapped persons.

18 Claims, 6 Drawing Figures

DEVICE FOR HANDLING PEOPLE

The present invention relates to devices for handling people and in particular those which provide easier manipulation of handicapped or sick persons. Devices for handling people are already known which essentially comprise a base surmounted by a support which itself supports an arm on which a seat is placed. The arm can generally be moved vertically in relation to the support, by means for example of a jack. The base is generally mounted on rollers enabling it to be moved in order to be able to take the persons to the desired locations.

It has been noted that the devices for handling people which are presently known nearly all have the same disadvantage, which is that they cannot access all the locations where the persons, in particular the handicapped or sick persons, are located. In particular, their configuration poses many problems due to the lack of being able to position the device in relation to the patient, depending upon the location of said patient.

Thus, the object of the present invention is to overcome these disadvantages, by producing a handling device with a very simple and therefore not cumbersome structure which, however, renders the manipulation of persons, such as handicapped or sick persons, very easy.

More specifically, the object of the present invention is a device for handling people comprising:

a base defining a first plane, a support fixed on said base, said support being constituted by a foot and support means, said foot and said support means being located more or less perpendicular to said first plane and defining a second plane, a seat, means for fixing said seat on said support means respectively in at least two possible positions which are more or less symmetrical in relation to said second plane and more or less parallel to said first plane, said support being fixed on said base such that said base comprises at least two support portions located on either side of said second plane and that, on the one hand, the value of their area is at least equal to the value of the area of said seat on a same side of said second plane and, on the other hand, the projection of the area of said seat which takes place and is contained in these two said support portions of bearing characterized by the fact that it comprises a slide bar able to cooperate with said support means and at least a back able to be positioned on said slide bar.

Other characteristics and advantages of the present invention will become apparent from the following description, which is given in relation to the attached drawings by way of illustration and which is in no way limiting.

DESCRIPTION OF THE PREFERRED EMBODIMENT

Figure 1:
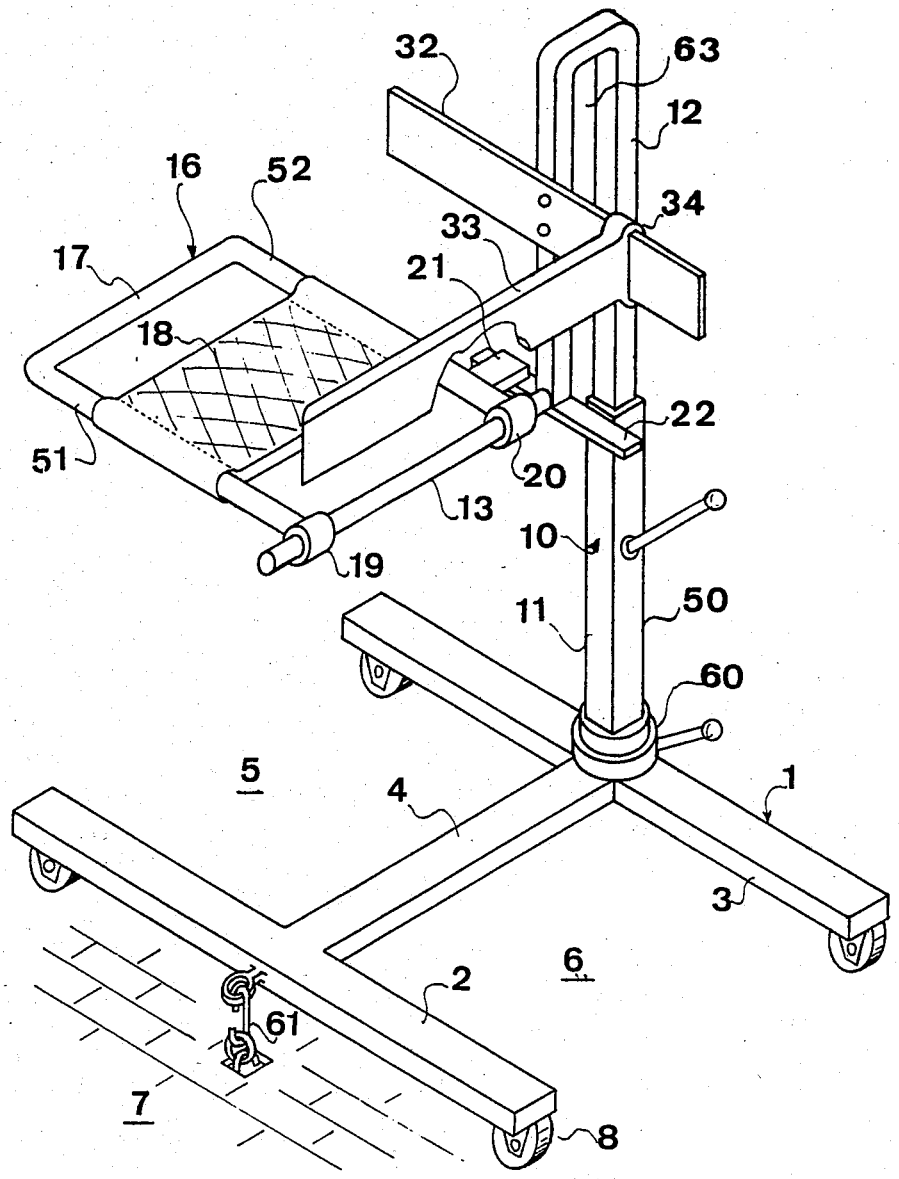
FIG. 1 represents a perspective view, which is partially cut away, of an embodiment of a device for handling people in accordance with the invention.
Figure 2:
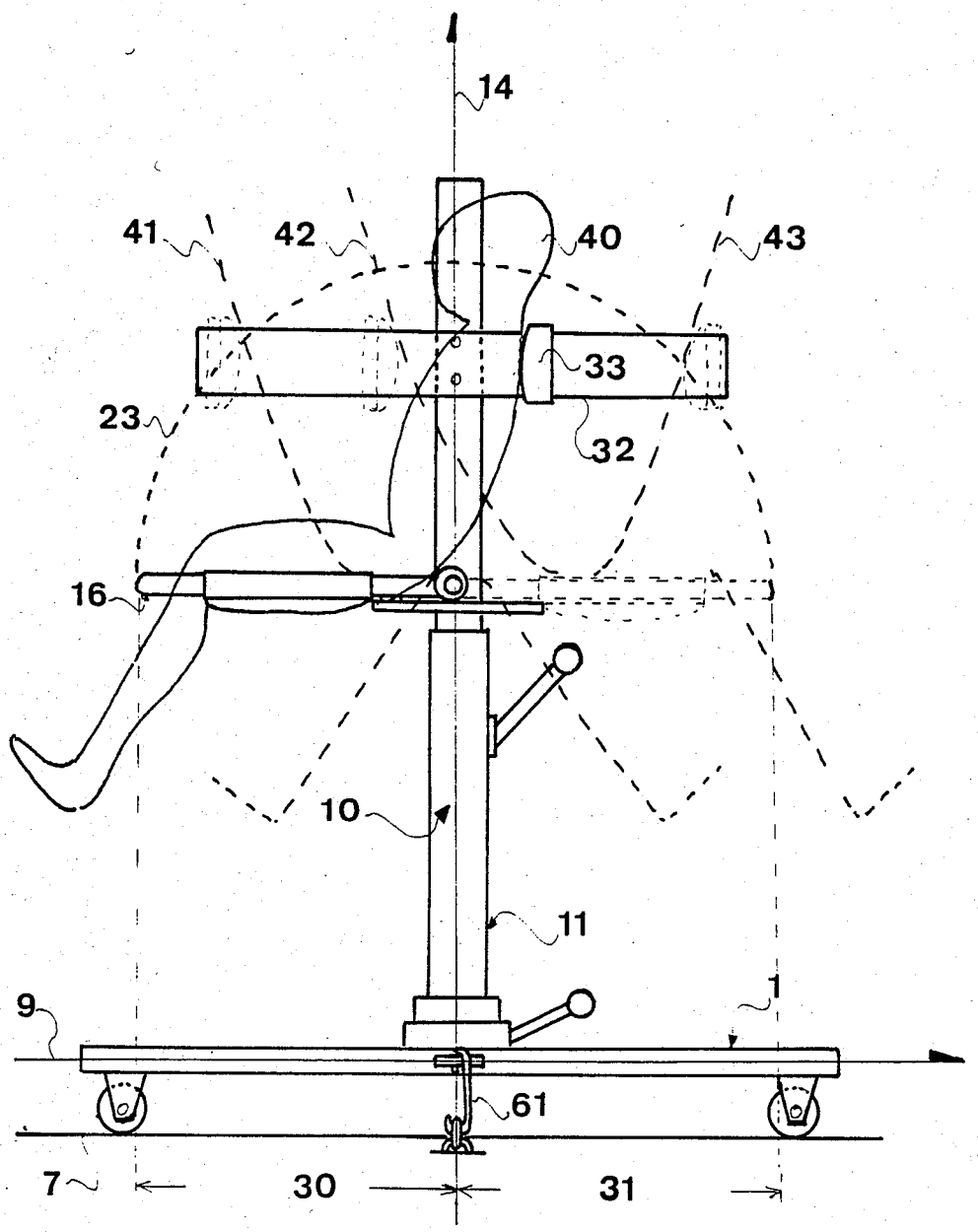
FIG. 2 represents a front view, in a schematic form, of the same embodiment of the handling device of FIG. 1, enabling the structure of said device as well as its advantages to be clearly understood.

The handling device shown in FIGS. 1 and 2 comprises a base 1 constituted by an element which is preferably H-shaped comprising two lateral bars 2 and 3 connected to each other by a median bar 4. This H-shaped structure provides the base 1 with two open U-shaped areas 5 and 6, respectively, on either side of the median bar 4 and which are defined by the two portions of the lateral bars 2 and 3 which are located on either side of the median bar 4. In addition, this base 1 contains means for being able to move it easily on a floor 7, such as for example four rollers 8.

The assembly of this base 1 formed more particularly by the two lateral bars 2 and 3 and the median bar 4 define a first general plane 9, said plane 9 being more or less parallel to the floor on which the handling device has to be moved when said device is in use.

In addition the device contains a support 10 comprising a foot 11 whose end 50 is fixed on the base 1 by any means. This support, in addition contains support means 12 in the form of an arm, which terminates in axle 13, defines an axis of rotation. This support 10 constituted essentially by the foot 11, support means 12 and axle 13 are situated more or less in a plane 14 which is preferably perpendicular to the plane 9 defined above.

The support means 12 are coupled to foot 11 by jack means which are not shown since they are well known per se. These jack means provide movement of the support means 12 in relation to foot 11 so as to be able to raise the patient more easily, as will be explained below, and possibly to take the patient into places such as, for example, a bathroom, above a bathtub. In this case the support means 12 are composed of a swan's neck in order to more easily be able to plunge the patient who is seated on the device into the bathtub, said swan's neck being able to partially envelope the edges of the bathtub in order to more easily place the patient on the bottom of said bathtub.

By way of illustration, the control means for the jack are shown schematically at 15.

As illustrated on the drawing, seat means 16 are positioned on axle 13, said seat means being composed of a U-shaped element 17 between whose lateral edges 51 and 52 a cloth 18, for example, is stretched which enables the patient to be received and supported. The lateral edges 51 and 52 of this U-shaped element 17 terminate respectively, with bearing means 19 and 20 which are able to pivot around said axle 13. An abutment 21 is associated with this U-shaped element 17 which can engage with a stop foot 22 which extends on either side of said axle 13 so that the seat 16 can pivot in a rotation as shown by arc 23 (FIG. 2), around axle 13 and take up the two symmetrical positions on either side of plane 14 as is clearly shown on FIG. 2. This abutment 21 enables to seat to be maintained in a more or less horizontal position in its two positions and therefore to be able to maintain the patient so that said patient remains perfectly seated.

Of course, this possible seat position in at least two symmetrical positions in relation to plane 14, which has been shown by rotation means, could also in certain cases be composed of translation slide bar grooves as to as be able to slide the seat along a horizontal plane so that it may take up the two symmetrical positions on either side of plane 14. Likewise axle 13 could be composed of two parallel axes so as to form a reference plane cooperating with symmetrical openings provided on a lateral edge of the seat and the two symmetrical positions of said seat would be obtained by positioning by turning the seat and making the openings cooperate with its two axes.

As has been mentioned above, the median 4 connecting the two lateral bars or support portions 2 and 3 is preferably located in plane 14.

The handling device thus produced contains therefore at least two support portions located on either side of plane 14, said two surfaces appear respectively at 30 and 31 on FIG. 2. These two portions are in fact shown by the two high and low parts of the H defining the base and they are situated on either side of the axis passing through the median bar 4 when said bar 4 is situated on plane 14.

The support portions 30 and 31 are selected such that they have a area at least equal to, if not greater than, the area of the surface of the seat which is located on a same side of plane 14 so as to constitute therefor a support polygon which is greater than the surface to receive the heavy body of a person so as to ensure the balance of the handling device for the safety of the person to be handled.

In addition, it is necessary for the projection of the surface of seat 16 on the support portions to be contained therein in order for the center of gravity which is basically situated on the person to be handled and who is seated on the seat to be projected into one or other of these two support portions depending on whether the seat is in one or other of these two symmetrical positions in relation to plane 14.

Moreover, preferably, a slide bar 32 is arranged on the support means 12. This slide bar 32 is more or less perpendicular to axle 13 and to the direction of arm 12 so as to be able to receive a back 33 which may be fixed by any means, in particular by clamping means 34 on slide bar 32. This back can be positioned in various positions along said slide bar 32 in order to take on all possible positions and at least, as is clearly shown on FIG. 2, four in the embodiment illustrated. These four positions are defined in accordance with the position of the person seated on the seat 16 and so as to be able to manipulate the person more easily, as will be explained below.

In the embodiment shown, seat 33 moves in relation to the slide bar 32, but an integrated system can be conceived in which the back 33 is fixed to the slide bar 32, and it is then the assembly which can move in translation in grooves which are used in relation to the support means 12. Under these circumstances, the device can contain two backs integrated with slide bar 32 so as to be able to provide safety in order to maintain the patient regardless of the manner in which the patient is seated on seat 16, with one of the backs holding the back of the patient and the other acting as a support bar, so that the patient may be maintained in complete safety on his seat.

Turning more particularly to FIG. 2, FIG. 2 illustrates all the possible positions taken by the seat 16 and the back 33 in the embodiment illustrated in FIG. 1. In effect, the solid line shows the position of the elements of the handling device in conformity with that which is shown on FIG. 1, i.e., in this case the patient is transported in a position such as that shown at 40. However, with this device, which in this respect has an advantage over the prior art device, it is possible to be able to transport or take the patient in other positions. In effect, with this device it is at least possible to position the patient in at least three other positions which are shown schematically by the dotted lines 41, 42 and 43.

Thus, with the two H-shaped cut-away portions 5 and 6 formed by the base 1, it is possible for example to bring the handling device supporting the patient opposite an element, such as for example just beneath a toilet due to these two openings in the two lateral uprights 2 and 3 which easily surround said toilet.

As has been mentioned, seat 16 can contain a strip of supporting cloth 18 so as to be able to position it more easily beneath the patient due to detachable means on either side on the lateral uprights 51 and 52. However, it is also conceivable that for questions of comfort, this seat be composed of other means, such as for example more comfortable cushions. Likewise, as mentioned above, handling in the vertical direction can be obtained by jack means so as, for example, to raise the patient from his bed and even to be able to take him to the edge of a bathtub and place him in same. In this case, preferably, foot 11 is connected to the base 1 by rotation means 60 which enable the support (with its seat) to have a rotation of 180° in relation to the base. Under these circumstances, the jack is controlled in order to raise the patient to the maximum so that he is able to pass above the edges of the bathtub before pivoting the support. For security, the base 1 can contain fastening means 61, for example on the lateral upright 2 opposite lateral upright 3 on which the foot 11 of support 10 is connected so as to be able for example to fasten it to a fastening means 62 situated in the floor and avoid rocking of the device when the patient is outside the support polygon defined by the base 1.

Under these circumstances, once the patient has passed above the edges of the bathtub, by means of the jack, the seat can be lowered so as to bring it with the patient to the bottom of the bathtub, said operation being facilitated by the swan's neck shape 63 of the support means 12.

As mentioned above, foot 11 is preferably fixed to base 1 such that it is on a lateral side of said base 1, for example on one of the lateral uprights 3 of said base and more or less in the middle thereof so as in particular to minimize the space taken up by this handling device. Blocking means for the support are also provided in order to avoid inopportune rotations and to maintain security in the stability of the device.

In addition, the length of slide bar 32 is determined so that the back can fully support the patient and can take at least the four positions shown in FIG. 2, in which case the length of slide bar 32 is equal to at least twice the width or depth of the seat, i.e., in effect, the depth of the U-shaped element 17.

Figure 3:
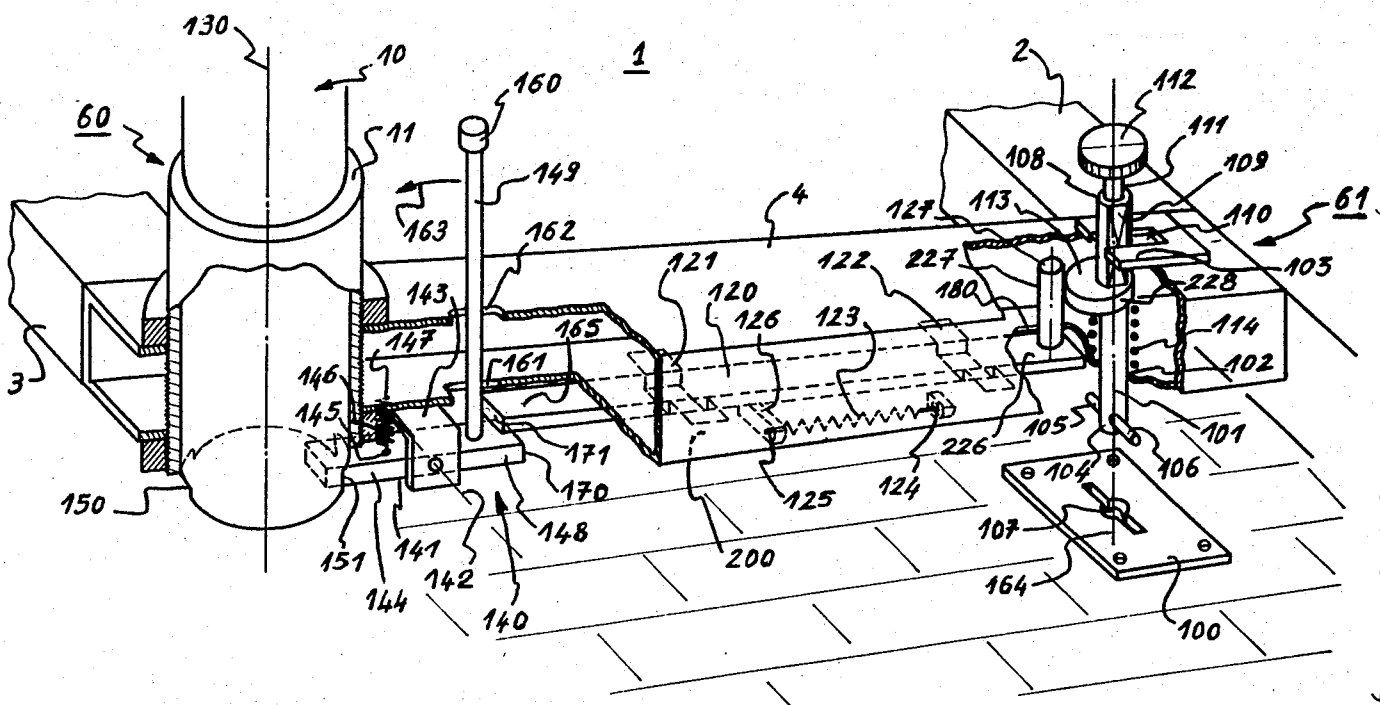
FIG. 3 represents a partially cut away perspective view of one part of the device for handling people relative to the means for connecting the device to the floor, FIGS. 4A, B and C represent an explanatory sketch illustrating the operation of the fixing means of FIG. 3.

FIGS. 3, 4A, B and C show more particularly an embodiment of the means for fastening this handling device to the floor.

More specifically, FIG. 3 shows a part of base 1 of the device for handling people and in particular the median bar 4 connecting the two lateral bars 3 and 2. Fastening means 61 are provided at the intersection of the median bar 4 and the lateral bar 2. These fastening means 61 intended to engage an anchoring plate 100 fixed to the floor are essentially composed of an anchoring stem 101 which is translatably slidable in two guides 102 and 103, respectively, end 104 of the anchoring stem comprising two lugs 105, 106, which can engage a complementary slit 107 provided in the anchoring plate 100 such that when these two lugs 105 and 106 penetrate into said slit and undergo a rotation, they position themselves respectively on either side of slit 107 and thus avoid traction being carried out on the anchoring stem 101 and disconnecting it from the floor.

In addition, end 108 of the anchoring stem 101 contains a flat guide 109 engaging a rectangular groove 110 in guide 103. This flat guide 109 is defined over a certain length which is generally less than the anchoring stem can move in translation in order to engage slit 107 which is provided in the anchoring plate. This length is, moreover, defined so that a cylindrical part 111 which is above said flat guide 109 can pivot in the rectangular groove 110 of stage 103.

The top of the anchoring stem 101 possibly ends in a manipulation knob 112 so as to be able, more easily, to control on the one hand the thrust of said anchoring stem 101 so as to make lugs 105 and 106 engage slit 107 and, on the other hand, to make it undergo a rotation of at least 90°. An eccentric 113 which is fixed on said stem is associated with said anchoring stem 101. By means of a spring 114, a thrust is exerted on said eccentric in the present embodiment such that said spring tends to always make the anchoring stem 101 rise up in order to separate it from slit 107.

In addition and preferably arranged under the lower surface 200 of the median wall 4, the device comprises a recopy bar 120 which can move in translation by sliding, respectively, for example in two guides 121 and 122 which are composed of supports fixed on surface 200 of the median wall 4. A traction spring 123 is associated with this recopy bar, one end 124 of said spring being fixed to the median bar 4 and the other end 125 being fixed by means of, for example, a foot 126 to the recopy bar 120. At end 226 of this recopy bar 120, located closest to the anchoring stem, a finger 127 is provided which is solidly connected to said bar 120 and whose lateral surface 227 is constantly laying against surface 228 of the eccentric 113. This finger is sufficiently long so as to always be in contact with section 228 of said eccentric 113 whatever the position of the anchoring stem, inserted or not. This is, moreover, obtained by the action of spring 123 which has the function of exerting a traction force on the recopy bar 120 so as to constantly maintain said finger 127 against said surface 228 of eccentric 113. At the other end of the median bar 4, more or less at the intersection of lateral bar 3 and said median bar 4, are located the foot 11 of the support 10 and the rotation means 60 enabling foot 11 of said support to be able to undergo rotations around an axis 130 which is generally perpendicular to the plane of the base, that is, in effect, to the floor on which this device for handling people must move.

Lockable-unlockable means 140 for the rotation of said foot are provided in proximity to foot 11 of support 10 and more or less at the end 165 of the recopy bar 120. Said means essentially comprise a rocking flange 141 which is able to pivot around a more or less horizontal axis 142 which is fixed to a support 143 which is soldered under the lower surface 200 of the median wall 4. This rocking flange therefore essentially contains two integral parts, located more or less on either side of this axis of rotation 142, of a more or less parallelipedal shape. On element 144 which is provided on the side of rotation means 60 of foot 11, to which an end 145 of a traction spring 146 is coupled, the other end 147 of the spring is fixed on the lower surface 200 of the median bar 4. The length of this element 144 of flange 141 is determined such that it can engage notches 150 or 151, as will be described below, which are provided in the bottom of foot 11 of support 10, said notches having a shape which is complementary to the exterior surface of element 144 of flange 141.

On the other element 148, opposite element 144 of flange 141, a handle 149 is provided, which ends with a prehension holder 160. This handle 149 and/or this holder 160 are accessible by traversing, in the present embodiment, the median bar 4 in order to be easily manipulated, through sufficiently large orifices 161 and 162 so that said handle 149 can undergo a rotation, as illustrated on the drawing by arrow 163.

In addition, element 148 of the rocking flange also has a length determined such that, as illustrated on the drawing, when the anchoring stem is in its rest or high position, that is, not engaging the anchoring plate 100 and therefore finger 127 is furthest from axis 164 of the anchoring stem, end 165 of the recopy bar 120 is above a portion of element 148 of the rocking flange 141. However, when the anchoring stem 101 undergoes a rotation, for example of 90° to the anchoring, since the finger is constantly laying against surface 228 of the eccentric 113, the recopy bar undergoes a translation under the action of spring 123 in order that the end 165 is no longer above element 148 of the rocking flange 141, and that it may rock and come more or less in a position such that its end surface 170 is opposite surface 171 of the end 165 of the recopy bar 120.

Finally, in a preferred embodiment, notches 150 and 151 have a different determined depth. Notch 151 is capable of engaging element 144 of the rocking flange when the seat is above the base 1, whereas notch 150 is capable of engaging element 148 when the seat is outside the support polygon of the device for handling people.

In this case the depth of notch 151 is sufficient in order for the rocking flange, under the action of spring 146, to completely disengage the two ends 170, 171, respectively, of the part of the flange 148 and 165 of the recopy bar, such that the end 165 comes above the end 148 of the rocking flange as mentioned above. On the other hand, the other notch 150 has a lesser depth and is determined in order that, when the foot has undergone a rotation of 180° (of course in the present illustrated embodiment that is where the patient has for example gone from the position above the base 1 to a position above a bathtub) notch 150 can be situated opposite element 144 of the flange 141, and that by a relatively small rotation this element 144 houses itself in notch 150, but that on the other hand, the end surface 170 of element 148 of flange 141 nevertheless remains at least partially opposite surface 171 of the end 165 of the recopy bar 120.

This operation will be described more fully with respect, in particular, to FIGS. 4A, B and C.

The embodiment illustrated in FIG. 3 is particularly useful when the median bar 4 is composed as a hollow profile due to its light weight. In this case, therefore, an arrangement such as that illustrated will be adopted, that is that the assembly of the rocking flange and the recopy bar 120 will be arranged under the lower surface 200 of this median bar 4, whereas the largest part of the anchoring stem 101, in particular the eccentric 113, the pressure spring 114 with the finger 127, will be arranged inside this median bar 4.

In this case the finger 127 which is connected to the bar 120 traverses the lower surface 200 of this median bar 4 through an oblong hole 180 which is sufficiently long to enable this finger to move in order to be separated from or moved closer to the anchoring stem 101.

Figure 4:
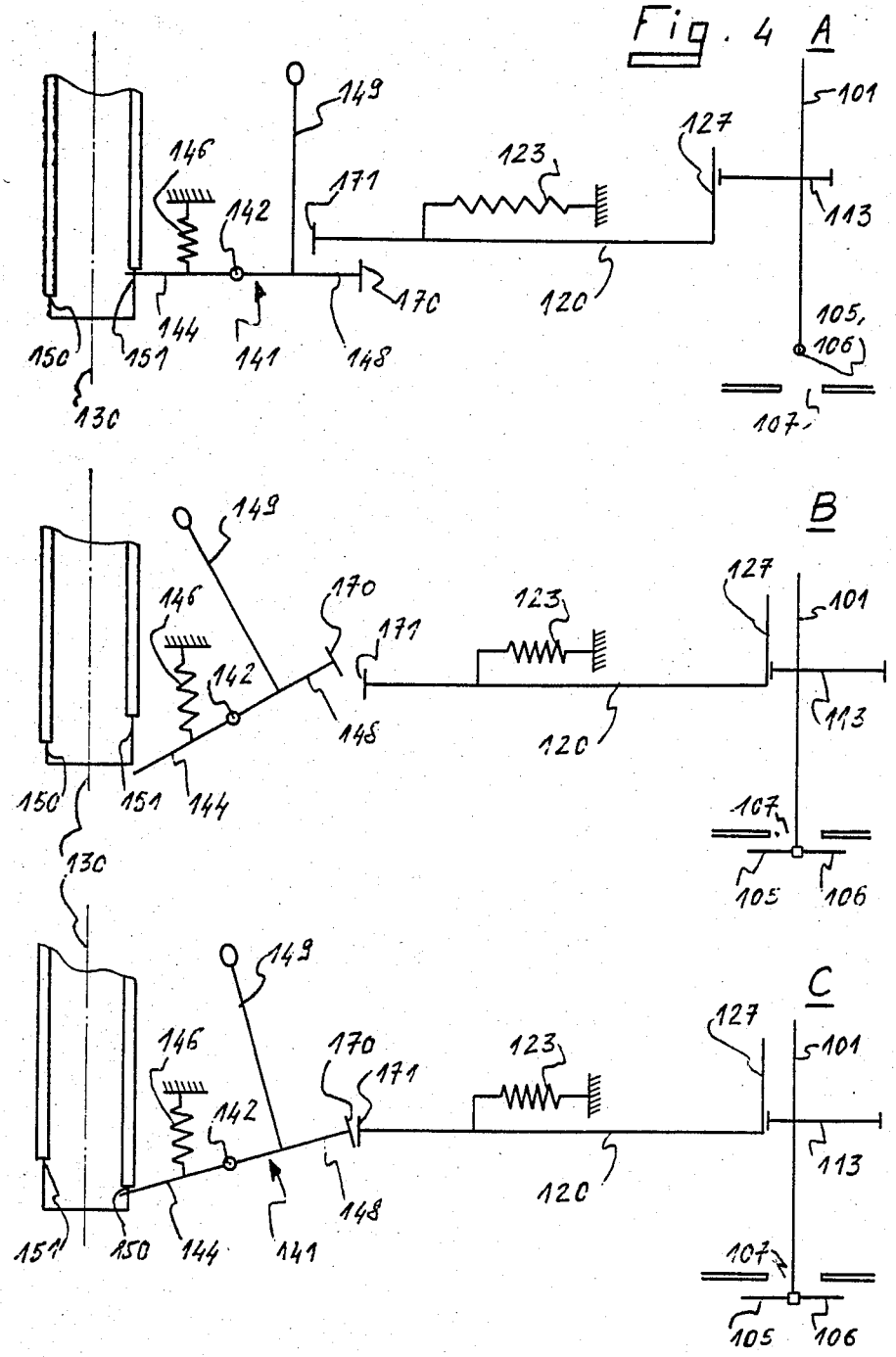

This operation is defined, more particularly with respect to FIGS. 4A, B and C which show, very schematically, the embodiment of FIG. 3, but in three different states. Thus, the references shown on FIG. 4 designate the same elements as those of FIG. 3.

Turning more particularly to FIG. 4A, FIG. 4A represents the rest position of the assembly of the device, that is, when the foot 11 of support 10 is turned such that the person being handled on the seat is located above base 1 and can be transported from one point to another. In this case, stem 101 is in its high position and finger 127 is laid against the surface of the eccentric 113 and it is the furthest possible from the axis of rotation 64 of stem 101. Under these circumstances, end 165 of the recopy bar 120 is above element 148 of flange 141. Flange 141, through its element 144, engages the bottom of notch 151 which is the deepest notch. From this starting position illustrated by FIG. 4A, let us then consider that the person is brought to a place where he must be positioned above a bathtub, as has been more fully described above.

In a first case, if we consider that more particularly the aid in charge of the patient wants to make the support pivot, said aid cannot do so without the device being anchored to the floor in order to avoid any rocking. In effect, without particular action on, for example, the anchoring stem 101, the support 10, in particular by its foot, is prevented from pivoting since the notch 151 engages element 144 of flange 141 and since it cannot pivot around a vertical axis. Under these circumstances, it is then necessary for the aid to move stem 101 in order to bring the lugs 105 and 106 opposite the longitudinal slit 107, then to exert a pressure force in translation on this stem in order to slide it guided by its flat guide 109 until the lugs 105 and 106 position themselves in a plane below the anchoring plate 100 for fixing to the floor. Under these circumstances the cylindrical part 111 is then in stage 103 and, consequently, the anchoring stem can easily pivot by activation of button 112. This can pivot for example by 90°, which means that the greater thickness of the eccentric which pushed back finger 127 pivots and makes this finger 127 move closer to the axis of rotation 164 of the anchoring stem 101. The traction spring 123 maintains finger 127 constantly laid against the lateral wall of this eccentric 113 and drives in translation the recopy bar 120, in order to bring it closer to axis 164 mentioned above. The end 165 of the recopy bar 120 disengages itself from the top of element 148 of the flange 141. When this first operation is completed, the aid can then take handle 149 and cause it to undergo a rotation such as is mentioned and schematically by arrow 163, FIG. 3, which in turn drives flange 141 in rotation around its axis 142. This rotation of flange 141 frees element 144 from groove 151. This effort on handle 149 is carried out against the force of traction spring 146. While keeping this handle 149 pushed, as illustrated on FIG. 4B, the aid can therefore then make support 10 pivot around its axis 130 in order to bring, as mentioned above, the patient above the bathtub. This is possible because, as is shown on FIG. 4B, element 144 of flange 141 is situated beneath the plane of the lowest end of foot 11 of support 10.

The patient can be brought to his position above the bathtub for example, since the handling device is well anchored to the ground and therefore does not risk being subjected to any inopportune rocking; the aid responsible for this operation can release the handle 149 which, under the action of spring 146, will undergo a rotation opposite to the preceding one in order for element 144 of flange 141 to then engage notch 150 which has placed itself more or less in the path of said element 144. However, as this notch 150 has a calculated depth which is less than that of notch 151, the flange 141 cannot undergo a complete rotation in order to revert to its starting position, its so-called rest position, as is illustrated on FIG. 4A. Thus surface 170 of the end of element 148 of the flange 141 remains more or less opposite surface 171 of the end 165 of the recopy bar 120 and thus prevents the recopy bar 120 from reverting to its starting position, as illustrated on FIG. 4A.

The portion of these elements, as described above, is perfectly visible on FIG. 4C.

This arrangement is advantageous since if, by inadvertence, when the patient is handled above the bathtub, someone were to detach the seat by, for example, pivoting the anchoring stem 101, this rotation would be prevented since finger 127 blocks the eccentric and thus the recopy bar is prevented from receding by element 148 of flange 141.

In order to be able to detach the seat from the floor, it is necessary for the aid to again move the handle 149 in order to detach the element 144 from notch 150 and then make the support 10 pivot by a reverse rotation in order to bring the deepest notch 151 opposite the element 144 of flange 141 in order for this flange 141 to undergo its complete rotation to bring it back to the rest position as illustrated in FIG. 4A.

In this manner the translation path of the recopy bar 120 is freed and it is then possible to detach the device since the eccentric can undergo its rotation by pushing back the finger against the traction spring 123 since the recopy bar 120 is not impeded in this translation.

It appears therefore from the description and the operation of the device for handling people that said device enables said seat to be anchored very easily to the floor in order to move the patients on their seats and to bring them to the desired locations in complete security, and thus avoid inopportune rocking which could cause accidents.

We claim:

1. A device for handling people comprising:

a base (1) defining a first plane (9), a support (10) fixed on said base (1), said support (10) being composed of a foot (11) and support means (12), said foot (11) and said support means (12) being situated substantially perpendicular to the first plane (9) and forming a second plane (14), a seat (16), means for fixing said seat on said support means respectively in two like positions on opposite sides of said second plane (14) and substantially parallel to said first plane (9), said support means being fixed on said base such that said base contains at least two support portions (30,31) situated on either side of said second plane (14) and that, on the one hand, the support portions have a surface area which is at least equal to the surface area of said seat (16) on a same side of said second plane (14) and, on the other hand, the projection of the surface area of said seat is made and is contained within these two said support portions (5, 6), characterized by the fact that said device contains a slide bar (32) which operatively engages and is fixed to said support means and at least one back slidably (33) positioned on said slide bar (32).

2. The device for handling people in accordance with claim 1, wherein said base (1) is composed of an H-shaped component comprising two lateral bars (2,3) connected by a median bar (4).

3. The device for handling people in accordance with claim 2, wherein said base (1) contains means for rolling on a floor (8).

4. The device for handling people in accordance with any one of claim 1 to 3, characterized by the fact that said device comprises means fastening for fixing said base to the floor (61).

5. The device for handling people in accordance with claim 4, further comprising locking-unlocking means (140) for the rotation of said support (10) responsive to the state of said means for fastening said device to the floor.

6. The device in accordance with claim 5, wherein said fastening means (101) comprise at least a stem for anchoring said device in the floor, and means for effecting two different angular positions of said stem corresponding respectively to an anchored position and a non-anchored position.

7. The device in accordance with claim 6, wherein said angular position effecting means comprises at least a recopy bar (120) for adjusting the angular position of said anchoring stem (101), and means (227), 113) for engaging said bar with said anchroing stem (101), in order to move said bar (120) between two positions corresponding to the two said angular positions of said stem (101), said first position of said bar corresponding to the anchored position of said stem (101), and said second position of said bar corresponding to the non-anchored position of said stem (101).

8. The device in accordance with claim 7, wherein said means for engaging said bar (120) with said stem (101) comprise an eccentric (113) connected to said stem (101), a pressure finger (127) connected to said bar and resilient means (123) for maintaining a constant bias of said finger (127) against said eccentric (113).

9. The device in accordance with claim 7, further comprising resilient means (114) capable of exerting a pressure force against said anchoring stem (101) tending to constantly bring it back to its non-anchored position.

10. The device in accordance with claim 7, wherein said anchoring stem (101) respectively engages two sliding guides (102, 103) provided in said base (1).

11. The device in accordance with claim 10, wherein at least one of the two said guides is composed of a rectangular groove (11), said stem comprising at least a flat guide (109) capable of engaging said groove, and a cylindrical element (111) following said flat guide, said cylindrical element (111) being capable of positioning itself in said groove when said stem is in its anchoring position.

12. The device in accordance with claim 5, wherein the means for locking-unlocking the rotation of said support comprises a flange (141) capable of taking at least first and second, positions, and control means (146, 149, 160) for controlling the position of said flange, said flange comprising at least two elements (114, 148), and including a first element (144) capable of engaging in a first position with at least a first match (151) provided in said support (10).

13. The device in accordance with claim 12, wherein said flange (141) is arranged on said base in order that at least said second element (148) of said flange engages an end (165) of said recopy bar (120) such that, when said first element (144) of said flange is in said notch (151), said notch having a determined depth, said second element (148) is located outside of the path of movement of said end (165) of said bar (120) and such that said bar (120) can position itself in said second position, but that to the contrary when said first element (144) of said flange (141) is situated outside of said notch (151) for the second position of said flange (141), said second element (148) of the flange is situated in the path of movement of said recopy bar (120) and prevents said bar (120) from being able to move by thus maintaining it more or less in its said first position.

14. The device in accordance with claim 13, wherein said support (10) contains a second notch (150) whose depth is determined in order that when the first element (144) of said flange (141) is engaged in said second notch (150), said second element (148) of said flange is also capable of being in the path of movement of said recopy bar (120) and thus prevents it from being able to move by maintaining it more or less in said first position.

15. The device for handling people in accordance with claim 1, wherein said support means are operatively coupled to said foot by a lifting means.

16. The device for handling people in accordance with claim 1, wherein said support means is of an inverted U-shape (63).

17. The device for handling people in accordance with claim 1, wherein said means for fixing the seat on said support means, respectively in at least two substantially symmetrical positions, comprises an axle (13) fixed to said support means, means for rotation (19, 20) of said seat around said axle (13) and means for blocking (21, 22) by abutment, said seat respectively in the two said positions.

18. The device for handling people in accordance with claim 1, wherein said support (10) is supported on said base (1) by rotation means (60) enabling said support (10) to pivot about its axis in relation to said base (1).

* * * * *